US011225077B2

(12) United States Patent
Murayama

(10) Patent No.: US 11,225,077 B2
(45) Date of Patent: Jan. 18, 2022

(54) LIQUID EJECTING HEAD AND LIQUID EJECTING SYSTEM

(71) Applicant: SEIKO EPSON CORPORATION, Tokyo (JP)

(72) Inventor: Toshiro Murayama, Fujimi-Machi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/910,483

(22) Filed: Jun. 24, 2020

(65) Prior Publication Data

US 2020/0406620 A1 Dec. 31, 2020

(30) Foreign Application Priority Data

Jun. 27, 2019 (JP) ..... JP2019-119683

(51) Int. Cl.
*B41J 2/14* (2006.01)

(52) U.S. Cl.
CPC .. *B41J 2/14233* (2013.01); *B41J 2002/14306* (2013.01)

(58) Field of Classification Search
None
See application file for complete search history.

(56) References Cited

U.S. PATENT DOCUMENTS

2013/0208059 A1* 8/2013 Arimoto ..... B41J 2/14233 347/85
2019/0366714 A1 12/2019 Tsukahara et al.

FOREIGN PATENT DOCUMENTS

JP 2003094652 A * 4/2003
JP 2018-103602 A 7/2018

* cited by examiner

*Primary Examiner* — Erica S Lin
(74) *Attorney, Agent, or Firm* — Workman Nydegger

(57) ABSTRACT

A first opening being a coupling port between the third flow path and the first flow path and a second opening being a coupling port between the second flow path and the first flow path are positioned toward the +Z direction, which is the first direction, of the first flow path.

9 Claims, 12 Drawing Sheets

LIQUID EJECTING HEAD AND LIQUID EJECTING SYSTEM

The present application is based on, and claims priority from JP Application Serial Number 2019-119683, filed Jun. 27, 2019, the disclosure of which is hereby incorporated by reference herein in its entirety.

BACKGROUND

1. Technical Field

The present disclosure relates to a liquid ejecting head and a liquid ejecting system that eject liquid from a nozzle, and more particularly, to an ink jet recording head and an ink jet recording system that eject ink as a liquid.

2. Related Art

There has been proposed a liquid ejecting system that circulates liquid inside a liquid ejecting head that ejects the liquid. The liquid ejecting system circulates the liquid to, for example, discharge bubbles contained in the liquid, suppress an increase in the viscosity of the liquid, and suppress settling of a component contained in the liquid in the liquid ejecting head (for example, refer to JP-A-2018-103602).

In the liquid ejecting head of JP-A-2018-103602, the liquid inside the liquid ejecting head is circulated through a branched flow path provided in the vicinity of the nozzles, thereby suppressing an increase in the viscosity caused by drying of the liquid not ejected from the nozzles.

However, there is a desire for a liquid ejecting head capable of more efficiently collecting the liquid in the vicinity of the nozzles.

This problem exists not only in an ink jet recording head but also similarly in a liquid ejecting head that ejects a liquid other than the ink.

SUMMARY

An advantage of some aspects of the present disclosure is to provide a liquid ejecting head and a liquid ejecting system capable of more efficiently collecting liquid in the vicinity of nozzles.

According to an aspect of the present disclosure, there is provided a liquid ejecting head that discharges a liquid from a nozzle, the liquid ejecting head including a first common liquid chamber and a second common liquid chamber that communicate with the nozzle, a pressurization chamber provided between the first common liquid chamber and the nozzle, a first flow path extending between the pressurization chamber and the nozzle in a first direction toward the nozzle, a second flow path branching from the first flow path and leading to the second common liquid chamber, and a third flow path that bypasses the pressurization chamber and leads to the first flow path from the first common liquid chamber, in which a first opening, which is a coupling port between the third flow path and the first flow path, and a second opening, which is a coupling port between the second flow path and the first flow path, are positioned in the first flow path in the first direction close to the nozzle.

According to another aspect of the present disclosure, there is provided a liquid ejecting system including the liquid ejecting head and a mechanism configured to supply a liquid to the liquid ejecting head, collect the liquid from the liquid ejecting head, and circulate the liquid.

DESCRIPTION OF EXEMPLARY EMBODIMENTS

Figure 1:
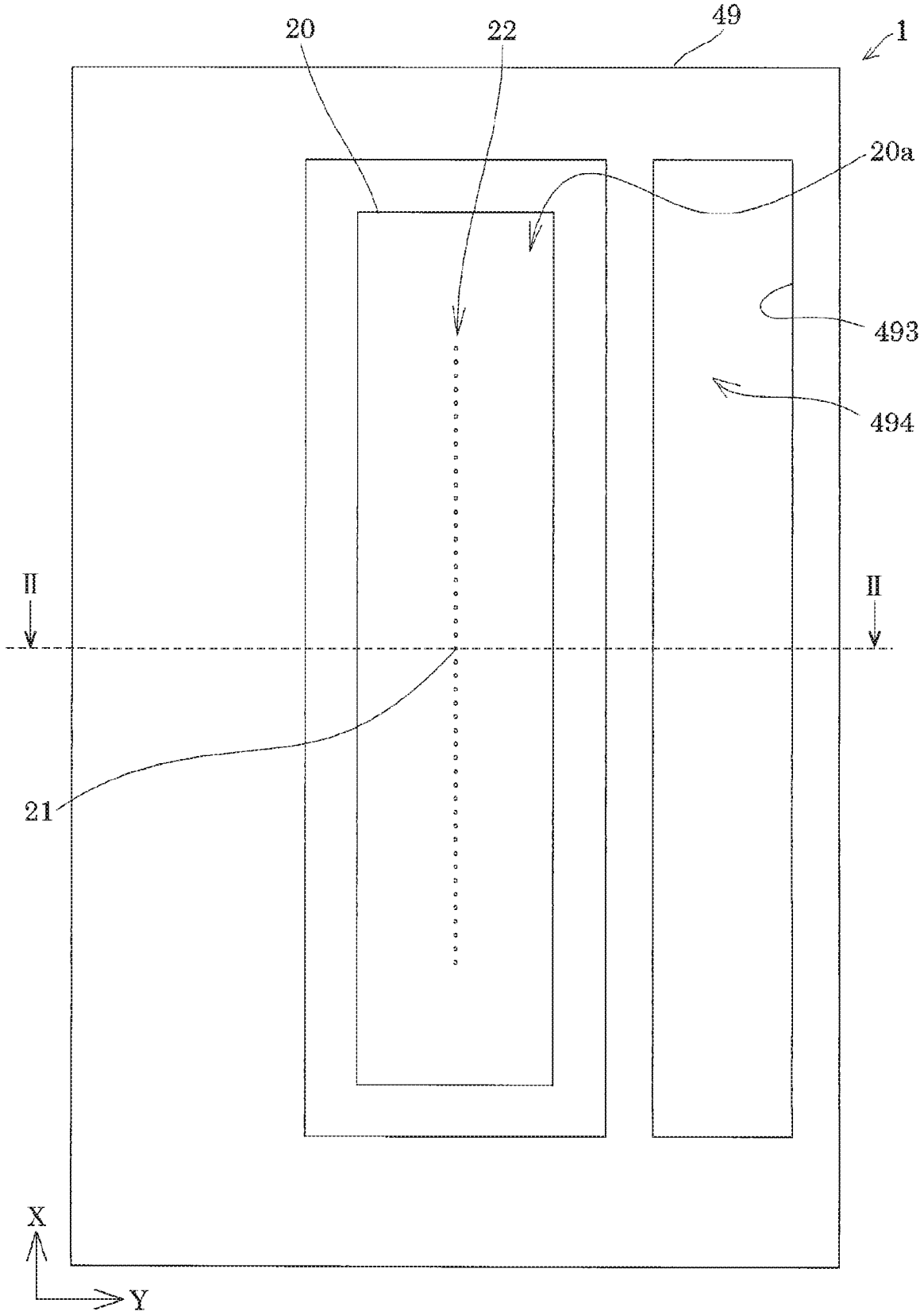
FIG. 1 is a plan view of a recording head according to Embodiment 1.

Hereinafter, the present disclosure will be described in detail based on the embodiments. However, the following description illustrates an embodiment of the present disclosure and may be optionally changed within the scope of the present disclosure. In the drawings, the same reference numerals denote the same members and the description thereof will be omitted as appropriate. In the drawings, X, Y, and Z represent three spatial axes orthogonal to each other. In the present specification, directions along these axes are defined as an X direction, a Y direction, and a Z direction. The directions of the arrows in the diagrams are illustrated as positive (+) directions and the directions opposite to the arrows are illustrated as negative (−) directions. The Z direction indicates a vertical direction, the +Z direction indicates vertically downward, and the −Z direction indicates vertically upward.

Embodiment 1

Figure 2:
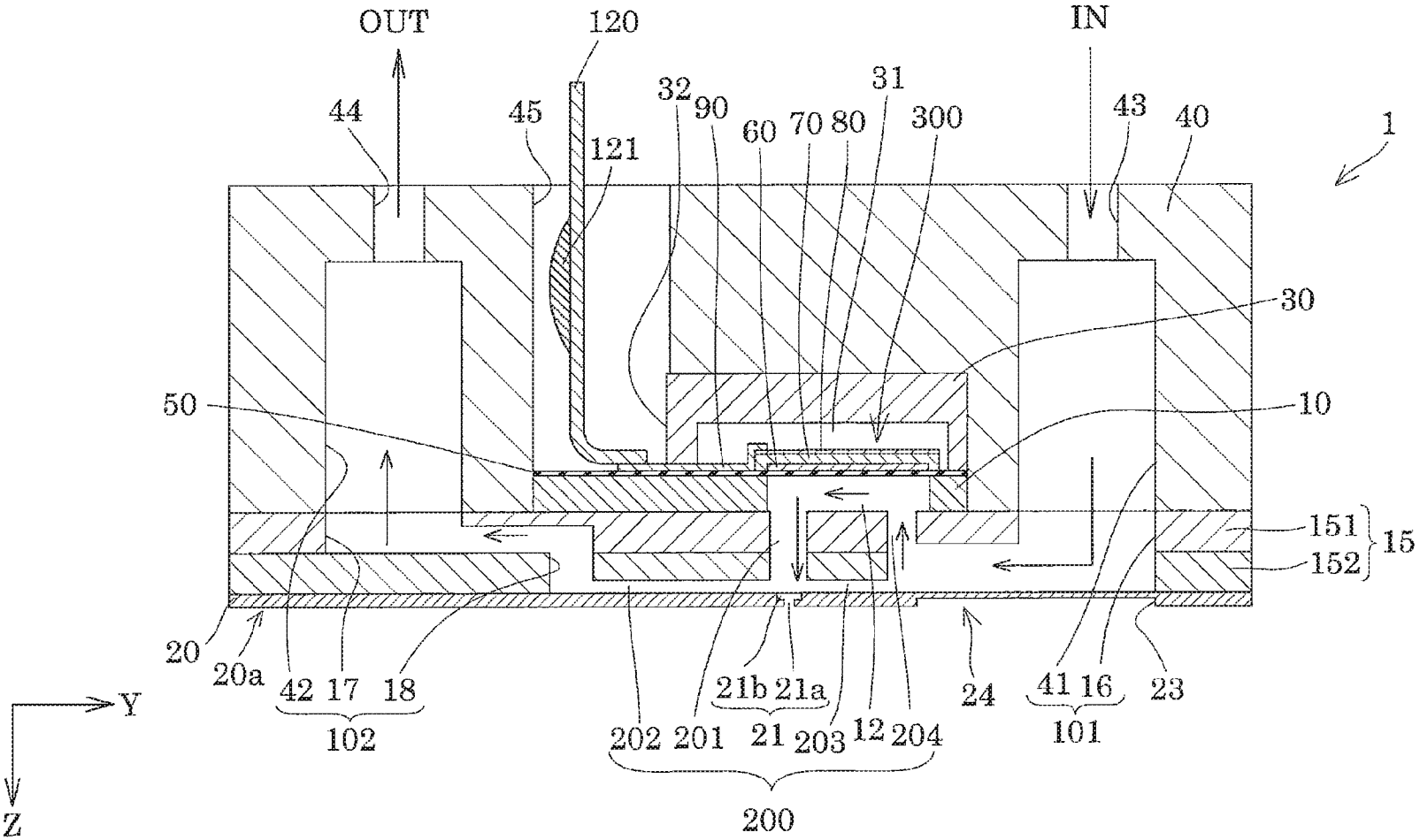
FIG. 2 is a sectional diagram of the recording head according to Embodiment 1.
Figure 3:
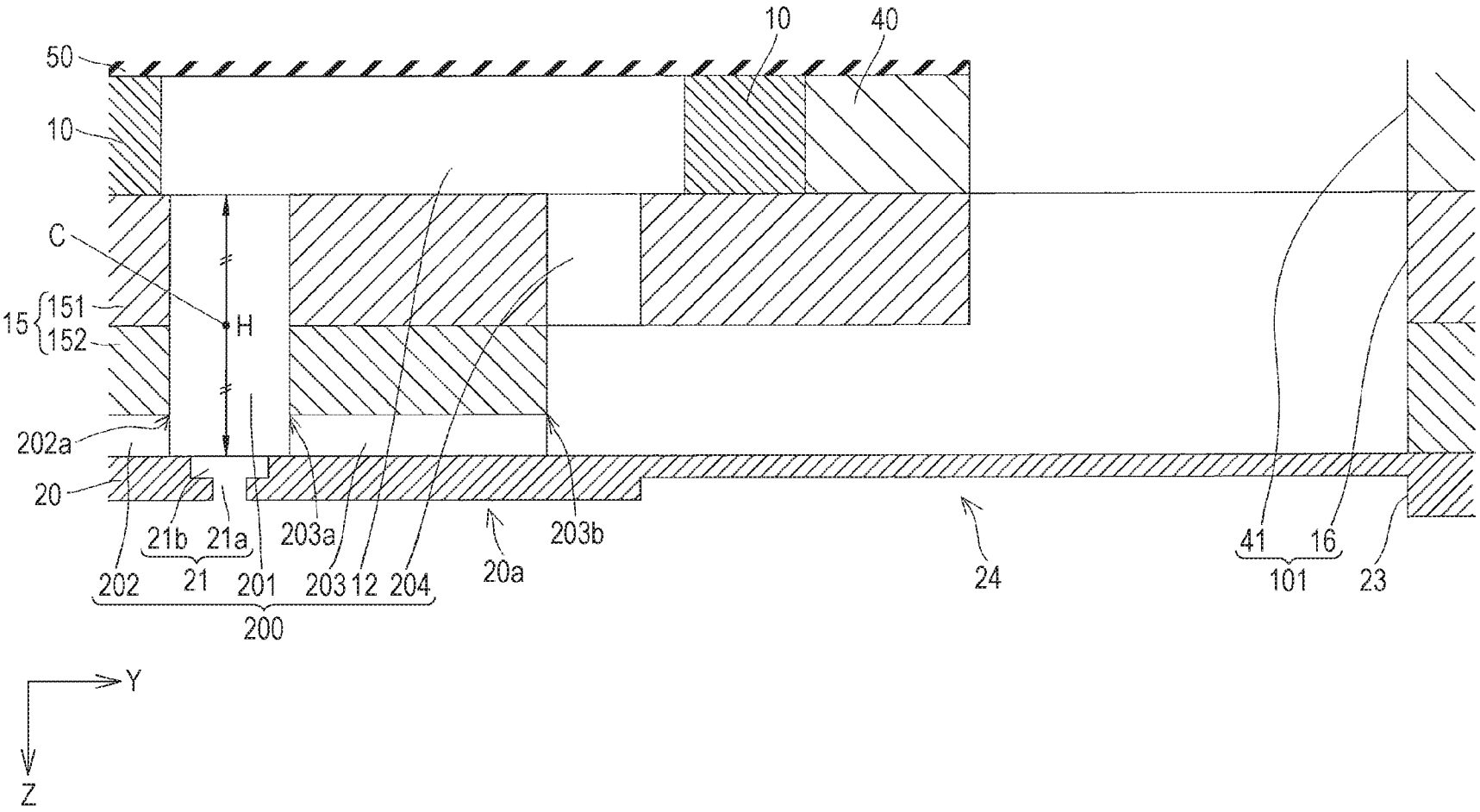
FIG. 3 is a sectional diagram of the recording head according to Embodiment 1.
Figure 4:
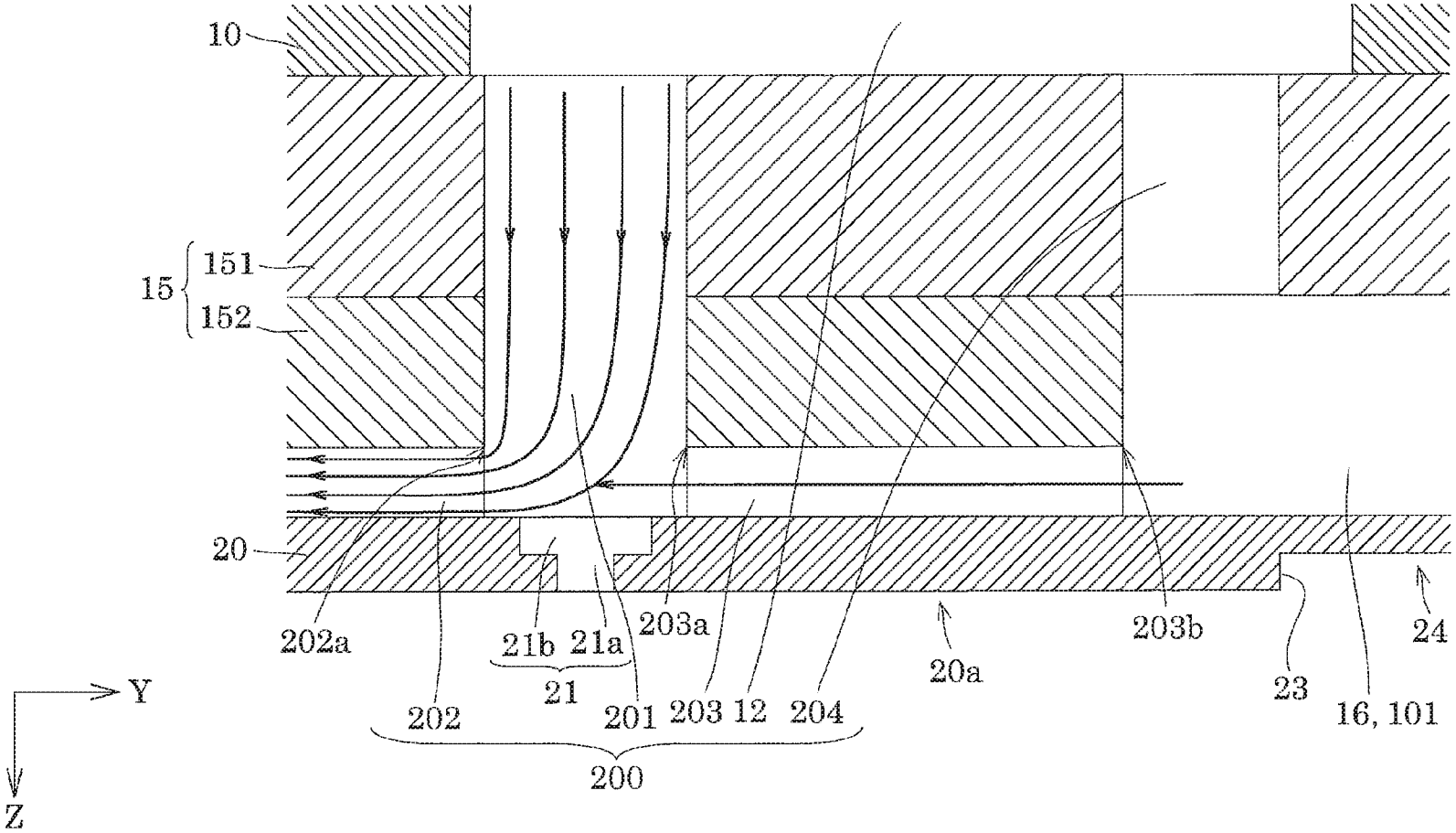
FIG. 4 is a sectional diagram illustrating streamlines of the recording head according to Embodiment 1.
Figure 5:
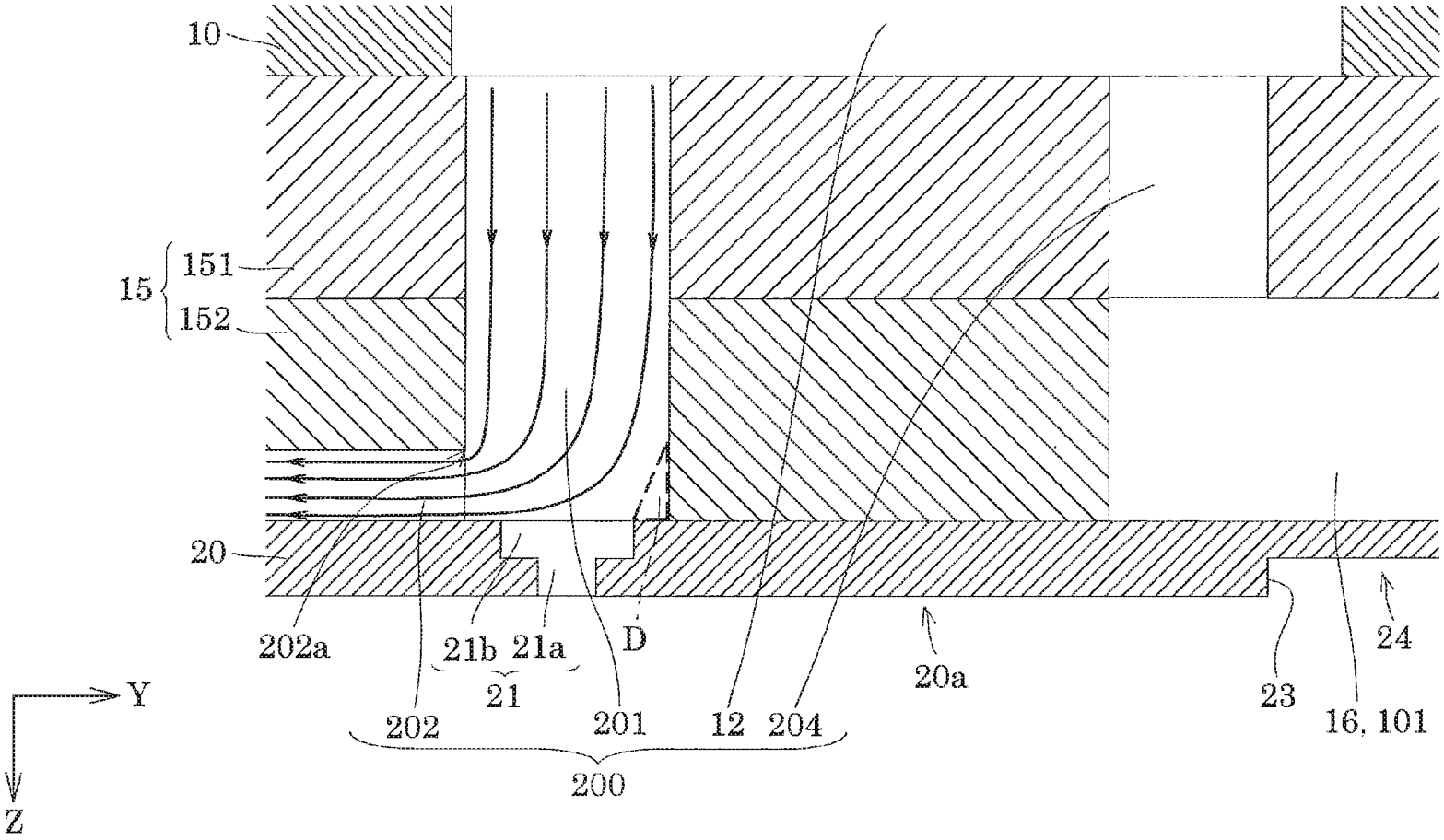
FIG. 5 is a sectional diagram illustrating streamlines of a comparative example of the recording head according to Embodiment 1.

An ink jet recording head, which is an example of the liquid ejecting head of the present embodiment, will be described with reference to FIGS. 1 to 5. FIG. 1 is a plan view of an ink jet recording head, which is an example of a liquid ejecting head according to Embodiment 1 of the present disclosure, as viewed from a nozzle surface side. FIG. 2 is a sectional diagram taken along line II-II of FIG. 1. FIG. 3 is an enlarged view of the main parts of FIG. 2. FIG. 4 is a diagram for explaining the streamlines inside the flow path of FIG. 3. FIG. 5 is a diagram illustrating the streamlines inside the flow path of a comparative example.

As illustrated in the drawings, an ink jet recording head 1 (hereinafter, also simply referred to as a recording head 1), which is an example of the liquid ejecting head of the present embodiment, is provided with members such as a flow path forming substrate 10 as flow path substrate, a communicating plate 15, a nozzle plate 20, a protection substrate 30, a case member 40, and the like.

The flow path forming substrate 10 is formed of a silicon single crystal substrate and a diaphragm 50 is formed at one surface of the flow path forming substrate 10. The diaphragm 50 may be a single layer or a laminate selected from a silicon dioxide layer and a zirconium oxide layer.

The flow path forming substrate 10 is provided with pressure chambers 12 which are pressurization chambers configuring the individual flow paths 200 and are partitioned by partition walls. The pressure chambers 12 are arranged at a predetermined pitch along the X direction in which the nozzles 21 that discharge the ink are arranged. In the present embodiment, one row of the pressure chambers 12 is provided such that the pressure chambers 12 are arranged in the X direction. The flow path forming substrate 10 is disposed such that the in-plane direction includes the X direction and the Y direction. In the present embodiment, the portions between the pressure chambers 12 arranged in the X direction of the flow path forming substrate 10 are referred to as partition walls. This partition walls are formed along the Y direction. In other words, the partition walls refer to portions overlapping the pressure chambers 12 in the Y direction of the flow path forming substrate 10.

Although the flow path forming substrate 10 is provided with only the pressure chambers 12 in the present embodiment, the flow path forming substrate 10 may be provided with a flow path resistance imparting portion having a narrower cross-sectional area crossing the flow paths than the pressure chambers 12 so as to impart the ink to be supplied to the pressure chambers 12 with a flow path resistance.

Piezoelectric actuators 300 are configured by forming the diaphragms 50 on one side of the flow path forming substrate 10 in the −Z direction and by laminating first electrodes 60, piezoelectric layers 70, and second electrodes 80 on the diaphragm 50 using film formation and lithography. In the present embodiment, the piezoelectric actuator 300 is an energy generating element that generates pressure changes in the ink inside the pressure chamber 12. Here, the piezoelectric actuator 300 is also referred to as a piezoelectric element and refers to a portion including the first electrode 60, the piezoelectric layer 70, and the second electrode 80. In general, one of the electrodes of the piezoelectric actuator 300 is used as a common electrode and the other electrode and the piezoelectric layer 70 are patterned for each pressure chamber 12. In the present embodiment, although the first electrode 60 is used as the common electrode of the piezoelectric actuator 300 and the second electrode 80 is used as the individual electrode of the piezoelectric actuator 300, there is no impediment to reversing this configuration in consideration of the drive circuit and wiring. In the example described above, although the diaphragm 50 and the first electrode 60 act as a diaphragm, the configuration is not limited thereto. For example, a configuration may be adopted in which the diaphragm 50 is not provided and only the first electrode 60 acts as a diaphragm. The piezoelectric actuator 300 itself may substantially serve as the diaphragm.

A respective lead electrode 90 is coupled to the second electrode 80 of each of the piezoelectric actuators 300 and a voltage is selectively applied to each of the piezoelectric actuators 300 via the lead electrodes 90.

The protection substrate 30 is joined to the −Z direction surface of the flow path forming substrate 10.

A piezoelectric actuator holding portion 31 having enough space to not hinder the motion of the piezoelectric actuator 300 is provided in a region of the protection substrate 30 facing the piezoelectric actuator 300. The piezoelectric actuator holding portion 31 only needs to have enough space to not hinder the motion of the piezoelectric actuator 300 and the space may be sealed or not sealed. The piezoelectric actuator holding portion 31 is formed to have a size that integrally covers the row of the piezoelectric actuators 300 arranged in the X direction. Naturally, the piezoelectric actuator holding portion 31 is not particularly limited to this configuration, and may individually cover the piezoelectric actuators 300, and may cover each group configured of two or more piezoelectric actuators 300 arranged in the X direction.

For the protection substrate 30, it is preferable to use a material having substantially the same coefficient of thermal expansion as the flow path forming substrate 10, for example, glass, ceramic material, or the like. In the present embodiment, a silicon single crystal substrate of the same material as the material of the flow path forming substrate 10 is used to form the protection substrate 30.

The protection substrate 30 is provided with a through-hole 32 extending through the protection substrate 30 in the Z direction. The end portion of the lead electrode 90 extending from each of the piezoelectric actuators 300 is provided to extend so as to be exposed inside the through-hole 32 and is electrically coupled to a flexible cable 120 inside the through-hole 32. The flexible cable 120 is a flexible wiring substrate, and in the present embodiment, a drive circuit 121 which is a semiconductor element is mounted to the flexible cable 120. The lead electrode 90 and the drive circuit 121 may be electrically coupled to each other without being coupled via the flexible cable 120. A flow path may be provided in the protection substrate 30.

The case member 40 that partitions a supply flow path communicating with the pressure chambers 12 and that partitions the protection substrate 30 is fixed onto the protection substrate 30. The case member 40 is joined to a surface of the protection substrate 30 on the side opposite from the flow path forming substrate 10 and is joined to the communicating plate 15 (described later).

The case member 40 is provided with a first liquid chamber portion 41 that forms part of a first common liquid chamber 101 and a second liquid chamber portion 42 that forms part of a second common liquid chamber 102. The first liquid chamber portion 41 and the second liquid chamber portion 42 are provided in the Y direction on both sides of one row of the pressure chambers 12.

Each of the first liquid chamber portion 41 and the second liquid chamber portion 42 has a concave shape opened on the −Z side surface of the case member 40 and is provided continuously to extend over the pressure chambers 12 arranged in the X direction.

The case member 40 is provided with a supply port 43 that communicates with the first liquid chamber portion 41 to supply the ink to the first liquid chamber portion 41 and a discharge port 44 that communicates with the second liquid chamber portion 42 and discharges the ink from the second liquid chamber portion 42.

Furthermore, the case member 40 is further provided with a coupling 45 which communicates with the through-hole 32 of the protection substrate 30 and through which the flexible cable 120 is inserted.

On the other hand, the communicating plate 15, the nozzle plate 20 is provided on the +Z side of the flow path forming substrate 10 which is the side opposite from the protection substrate 30.

Nozzles 21 that eject the ink in the +Z direction are formed in the nozzle plate 20. In the present embodiment, as illustrated in FIG. 1, the nozzles 21 are disposed in a straight line along the X direction, thereby forming one nozzle row 22.

Each nozzle 21 includes a first nozzle 21*a* and a second nozzle 21*b* having different inner diameters disposed next to each other in the Z direction which is the plate thickness direction of the nozzle plate 20. The first nozzle 21*a* has a smaller inner diameter than the second nozzle 21*b*. The first nozzle 21*a* is disposed outside, that is, on the +Z side of the nozzle plate 20 and ink is ejected to the outside as an ink droplet from the first nozzle 21*a* in the +Z direction. In other words, the second axial direction in which the ink of the present embodiment is discharged is the Z direction in the present embodiment.

The second nozzle 21*b* is disposed on the −Z side of the nozzle plate 20 and communicates with a first flow path 201 extending in the Y direction which is described later in detail. In other words, the first axial direction, which is the extending direction of the first flow path 201, is the Y direction in the present embodiment. The Y direction which is the first axial direction and the Z direction which is the second axial direction are orthogonal to each other.

It is possible to improve the flow speed of the ink by providing the nozzle 21 with the first nozzle 21*a* having a relatively small inner diameter and it is thus possible to improve the flight speed of the ink droplet ejected from the nozzle 21. By providing the nozzle 21 with the second nozzle 21*b* having a relatively large inner diameter, when so-called circulation is performed in which the ink inside the individual flow path 200 is caused to flow from the first common liquid chamber 101 toward the second common liquid chamber 102 (described in detail later), it is possible to reduce the portion of the nozzle 21 that is not influenced by the circulation flow inside the nozzle 21. In other words, it is possible to generate an ink flow inside the second nozzle 21*b* during the circulation and it is possible to increase the velocity gradient of the ink inside the nozzle 21 to replace the ink inside the nozzle 21 with new ink supplied from upstream. However, when the inner diameter of the second nozzle 21*b* is excessively large as compared with the inner diameter of the first nozzle 21*a*, the ratio of the inertance between the second nozzle 21*b* and the first nozzle 21*a* increases, and the position of the meniscus of the ink inside the nozzle 21 is not stable when the ink droplets are continuously discharged. In other words, when the ratio of the inertance between the second nozzle 21*b* and the first nozzle 21*a* increases, the meniscus of the ink moves into the second nozzle 21*b* instead of being retained inside the first nozzle 21*a* and it is no longer possible to continue the stable discharging of the ink droplets.

When the inner diameter of the second nozzle 21*b* is excessively small, the ink flow inside the second nozzle 21*b* during the circulation is less likely to occur. When the inner diameter of the second nozzle 21*b* is excessively small, the flow path resistance from the pressure chamber 12 to the nozzle 21 increases and the pressure loss increases, and the weight of the ink droplet discharged from the nozzle 21 therefore decreases. As a result, the piezoelectric actuator 300 is to be driven at a higher drive voltage and the discharging efficiency is reduced. Accordingly, the sizes of the first nozzle 21*a* and the second nozzle 21*b* are determined, as appropriate, in consideration of the ink replacement performance during circulation, the discharging stability, the discharging efficiency, the flight speed of the ink droplet, and the like.

The first nozzle 21*a* and the second nozzle 21*b* are provided so that the opening shapes thereof are substantially the same in the Z direction. Accordingly, a level difference is formed between the first nozzle 21*a* and the second nozzle 21*b*. Naturally, the shapes of the first nozzle 21*a* and the second nozzle 21*b* are not limited thereto, and for example, the inner surface of the second nozzle 21*b* may be an inclined surface inclined with respect to the Z direction. In other words, the inner diameter of the second nozzle 21*b* may be provided so as to gradually decrease toward the first nozzle 21*a*. Accordingly, for example, a level difference may not be formed between the first nozzle 21*a* and the second nozzle 21*b* and a continuous inner surface may be formed. In this manner, when the inner surfaces of the first nozzle 21*a* and the second nozzle 21*b* are continuous, the first nozzle 21*a* refers to a portion in which the opening shape is substantially the same in the Z direction.

The shape of the nozzle 21 when viewed in plan view in the Z direction is not particularly limited, and may be a circle, an ellipse, a rectangle, a polygon, an egg shape, or the like.

It is possible to form the nozzle plate 20 by using, for example, a metal such as stainless steel (SUS), an organic material such as a polyimide resin, or a flat plate material such as silicon. The plate thickness of the nozzle plate 20 is preferably 60 μm to 100 μm. By using the nozzle plate 20 having such a plate thickness, it is possible to improve the handleability of the nozzle plate 20 and to improve the ease of assembly of the recording head 1. Although it is possible to reduce the size of a portion of the nozzle 21 that is not influenced by the circulation flow inside the nozzle 21 during the circulation of the ink by reducing the length of the nozzle 21 in the Z direction, it is necessary to reduce the thickness of the nozzle plate 20 in the Z direction in order to reduce the length of the nozzle 21 in the Z direction. When the thickness of the nozzle plate 20 is reduced in this manner, there is an increase in the likelihood of the rigidity of the nozzle plate 20 being reduced and the deformation of the nozzle plate 20 causing variation in the discharging direction of the ink droplets, and an increase in the likelihood of a reduction in the handleability of the nozzle plate 20 causing a reduction in the ease of assembly to occur. In other words, by using the nozzle plate 20 having a certain degree of thickness as described above, it is possible to suppress a reduction in the rigidity of the nozzle plate 20 and it is possible to suppress the occurrence of variation in the discharging direction caused by the deformation of the nozzle plate 20 and a reduction in the ease of assembly caused by a reduction in the handleability.

The communicating plate 15 includes a first communicating plate 151 and a second communicating plate 152 in the present embodiment. The first communicating plate 151 and the second communicating plate 152 are laminated in the Z direction such that the first communicating plate 151 is on the −Z side and the second communicating plate 152 is on the +Z side.

The first communicating plate 151 and the second communicating plate 152 which form the communicating plate 15 may be made of a metal such as stainless steel, glass, a ceramic material, or the like. It is preferable that the communicating plate 15 be formed by using a material having substantially the same thermal expansion coefficient as that of the flow path forming substrate 10. In the present embodiment, the communicating plate 15 is formed by using a silicon single crystal substrate of the same material as the material of the flow path forming substrate 10.

The communicating plate 15 is provided with a first communicating portion 16 which communicates with the first liquid chamber portion 41 of the case member 40 to form a portion of the first common liquid chamber 101, and a second communicating portion 17 and a third communicating portion 18 which communicate with the second liquid chamber portion 42 of the case member 40 to form a portion of the second common liquid chamber 102. As will be described in detail later, the communicating plate 15 is provided with a flow path that communicates the first common liquid chamber 101 and the pressure chamber 12 with each other, a flow path that communicates the pressure chamber 12 and the nozzle 21 with each other, and a flow path that communicates the nozzle 21 with the second common liquid chamber 102 with each other. The flow paths provided in the communicating plate 15 form a portion of the individual flow path 200.

The first communicating portion 16 is provided at a position overlapping the first liquid chamber portion 41 of the case member 40 in the Z direction and is provided to extend through the communicating plate 15 in the Z direction to be opened in both the +Z side surface and the −Z side surface of the communicating plate 15. The first communicating portion 16 forms a first common liquid chamber 101 by communicating with the first liquid chamber portion 41 on the −Z side. In other words, the first common liquid chamber 101 is formed by the first liquid chamber portion 41 of the case member 40 and the first communicating portion 16 of the communicating plate 15. The first communicating portion 16 extends in the −Y direction to a position overlapping the pressure chamber 12 in the Z direction on the +Z side. The first common liquid chamber 101 may be formed by the first liquid chamber portion 41 of the case member 40 without providing the first communicating portion 16 in the communicating plate 15.

The opening on the +Z side of the first communicating portion 16 is blocked by the nozzle plate 20. A recessed portion 23 that opens in the +Z direction is provided in a portion of the nozzle plate 20 that blocks the opening on the +Z side of the first communicating portion 16. As described above, by providing the recessed portion 23 in the nozzle plate 20, the portion of the nozzle plate 20 that blocks the first communicating portion 16 is a compliance portion 24 that is a flexible portion having a smaller thickness in the Z direction than other portions. By providing the compliance portion 24 on the wall forming the first common liquid chamber 101 in this manner, it is possible to absorb the pressure fluctuation inside the first common liquid chamber 101 by the compliance portion 24 being deformed. In the present embodiment, although the recessed portion 23 serving as the compliance portion 24 is provided in the nozzle plate 20 to open on the +Z side, the configuration is not particularly limited thereto, and the recessed portion 23 may be provided to open on the −Z side, that is, to open to the inside of the first common liquid chamber 101. A through-hole communicating with the first communicating portion 16 may be provided in the nozzle plate 20 without providing the compliance portion on the nozzle plate 20 and a compliance substrate including the compliance portion which is a separate member from the nozzle plate 20 may be provided on the +Z side surface of the nozzle plate 20. Naturally, the compliance portion is not limited to being formed on the +Z side wall of the first common liquid chamber 101, may be formed on the wall surface of the first common liquid chamber 101 in the +Y direction, and may be formed on the −Z side surface of the case member 40.

The second communicating portion 17 is provided at a position overlapping the second liquid chamber portion 42 of the case member 40 in the Z direction and is provided to be open on the −Z side surface of the first communicating plate 151. The second communicating portion 17 is provided to widen toward the nozzle 21 in the +Y direction on the +Z side.

The third communicating portion 18 is provided to extend through the second communicating plate 152 in the Z direction such that one end of the third communicating portion 18 communicates with a portion of the second communicating portion 17 that is widened in the +Y direction. The opening on the +Z side of the third communicating portion 18 is covered by the nozzle plate 20. In other words, by providing the second communicating portion 17 on the first communicating plate 151, only the opening on the +Z side of the third communicating portion 18 may be covered by the nozzle plate 20, and thus, it is possible to provide the nozzle plate 20 in a relatively small area and it is possible to reduce the cost.

The second common liquid chamber 102 is formed by the second communicating portion 17 and the third communicating portion 18 provided in the communicating plate 15 and the second liquid chamber portion 42 provided in the case member 40. The second common liquid chamber 102 may be formed by the second liquid chamber portion 42 of the case member 40 without providing the second communicating portion 17 and the third communicating portion 18 in the communicating plate 15.

The flow path forming substrate 10, the communicating plate 15, the nozzle plate 20, and the like which form the flow path substrate are provided with the individual flow paths 200 which communicate with the first common liquid chamber 101 and the second common liquid chamber 102 and through which the ink in the first common liquid chamber 101 flows to the second common liquid chamber 102. Here, each of the individual flow paths 200 of the present embodiment is provided for corresponding one of the nozzles 21 in communication with the first common liquid chamber 101 and the second common liquid chamber 102, and includes the nozzle 21. The individual flow paths 200 are arranged along the X direction, which is the direction in which the nozzles 21 are arranged. Two of the individual flow paths 200 adjacent in the X direction, which is the direction in which the nozzles 21 are arranged, are provided to communicate with the first common liquid chamber 101 and the second common liquid chamber 102, respectively. In other words, the individual flow paths 200 provided for the nozzles 21 are provided in communication only with the first common liquid chamber 101 and the second common liquid chamber 102, respectively, and the individual flow paths 200 do not communicate with each other except by the first common liquid chamber 101 and the second common liquid chamber 102. In other words, in the present embodiment, a flow path provided with one nozzle 21 and one pressure chamber 12 is referred to as the individual flow path 200, and each of the individual flow paths 200 is provided to communicate with the other individual flow paths 200 only by the first common liquid chamber 101 and the second common liquid chamber 102.

As illustrated in FIGS. 2 and 3, the individual flow path 200 includes the nozzle 21, the pressure chamber 12, the first flow path 201, a second flow path 202, a third flow path 203, and a supply path 204.

The pressure chamber 12 is provided between the recessed portion provided in the flow path forming substrate 10 and the communicating plate 15 as described above and extends in the Y direction. In other words, the pressure chamber 12 is provided such that the supply path 204 is coupled to one end portion of the pressure chamber 12 in the Y direction, the second flow path 202 is coupled to the other end portion in the Y direction, and the ink flows inside the pressure chamber 12 in the Y direction. In other words, the direction in which the pressure chamber 12 extends refers to the direction in which the ink flows inside the pressure chamber 12.

In the present embodiment, only the pressure chamber 12 is formed in the flow path forming substrate 10. However, the configuration is not limited thereto, and the upstream end portion of the pressure chamber 12, that is, the end portion in the +Y direction may be provided with the flow path resistance imparting portion having the cross-sectional area narrower than that of the pressure chamber 12 to impart flow path resistance.

The supply path 204 couples the pressure chamber 12 to the first common liquid chamber 101 and is provided to extend through the first communicating plate 151 in the Z direction. The supply path 204 communicates with the first common liquid chamber 101 at the end portion on the +Z side and communicates with the pressure chamber 12 at the end portion on the −Z side. In other words, the supply path 204 extends in the Z direction. Here, the direction in which the supply path 204 extends refers to the direction in which the ink flows inside the supply path 204.

The first flow path 201 is provided between the pressure chamber 12 and the nozzle 21 to extend in the +Z direction toward the nozzle 21. The direction in which the first flow path 201 extends refers to the direction in which the ink flows inside the first flow path 201. In other words, the first axial direction in which the first flow path 201 extends is the +Z direction in the present embodiment. In the present embodiment, the first flow path 201 is provided to extend through the communicating plate 15 in the Z direction, communicates with the pressure chamber 12 at an end portion in the −Z direction, and communicates with the second flow path 202 at an end portion in the +Z direction.

In the present embodiment, the first flow path 201 is provided such that a cross-sectional area crossing the ink flowing through the flow path, that is, a cross-sectional area in the plane direction including the X direction and the Y direction has the same area in the Z direction. The first flow path 201 may be provided such that the flow path-crossing cross-sectional area has a different area in the Z direction. The difference in the area crossing the first flow path 201 includes a case in which the width in the X direction is different along the Z direction, a case in which the width in the Y direction is different along the Z direction, and a case in which both are different.

The flow path-crossing cross-sectional shape of the first flow path 201, that is, the cross-sectional shape in the plane direction including the X direction and the Y direction is rectangular. The flow path-crossing cross-sectional shape of the second flow path 202 is not particularly limited, and may be a polygonal shape, a circular shape, an elliptical shape, an egg shape, or the like.

The first flow path 201 refers to a portion formed in the communicating plate 15. In other words, the first flow path 201 extends from the bottom surface of the pressure chamber 12 in the +Z direction to the portion covered by the nozzle plate 20.

The nozzle 21 is disposed at a position communicating with the end portion of the first flow path 201. In other words, the nozzle 21 is disposed at a position overlapping the first flow path 201 when viewed in plan view in the Z direction. Accordingly, ink droplets are discharged from the nozzle 21 in the +Z direction.

The second flow path 202 branches from the first flow path 201 and leads to the second common liquid chamber 102. In the present embodiment, the second flow path 202 is provided to extend in the Y direction between the first flow path 201 and the second common liquid chamber 102. The direction in which the second flow path 202 extends is the direction in which the ink inside the second flow path 202 flows. The +Y direction end portion of the second flow path 202 communicates with the first flow path 201 and the −Y direction end portion of the second flow path 202 communicates with the third communicating portion 18 of the second common liquid chamber 102.

The second flow path 202 of the present embodiment is provided between the second communicating plate 152 and the nozzle plate 20. Specifically, the second flow path 202 is formed by providing a recessed portion in the second communicating plate 152 and covering the opening of the recessed portion with the nozzle plate 20. The second flow path 202 is not particularly limited to this configuration and a recessed portion may be provided in the nozzle plate 20 and the recessed portion of the nozzle plate 20 may be covered with the second communicating plate 152, or alternatively, a recessed portion may be provided in both the second communicating plate 152 and the nozzle plate 20.

In the present embodiment, the second flow path 202 is provided such that a cross-sectional area crossing the ink flowing through the flow path, that is, a cross-sectional area in the plane direction including the X direction and the Z direction has the same area over the Y direction. The second flow path 202 may be provided such that the flow path-crossing cross-sectional area has a different area over the Y direction. The difference in the area crossing the second flow path 202 includes a case in which the height in the Z direction is different along the Y direction, a case in which the width in the X direction is different along the Y direction, and a case in which both are different.

The flow path-crossing cross-sectional shape of the second flow path 202, that is, the cross-sectional shape in the plane direction including the X direction and the Z direction is rectangular. The flow path-crossing cross-sectional shape of the second flow path 202 is not particularly limited, and may be a trapezoid, a semicircle, a semi-ellipse, or the like.

It is preferable that the cross-sectional area crossing the ink flowing through the first flow path 201 with which the nozzle 21 communicates be larger than the cross-sectional area crossing the ink flowing through the second flow path 202. The cross-sectional area crossing the first flow path 201 is the area of a cross-section in the plane direction including the X direction and the Y direction. The cross-sectional area crossing the second flow path 202 is the area of a cross-section in the plane direction including the X direction and the Z direction. By making the cross-sectional area of the first flow path 201 relatively large in this manner, it is possible to suppress a decrease in the flow path resistance from the pressure chamber 12 to the nozzle 21 to suppress reductions in the discharging properties of the ink, in particular, in the weight of the ink droplets to be discharged. In particular, by widening the first flow path 201 in the Y direction to increase the cross-sectional area of the first flow path 201, it is possible to reduce the flow resistance in the first flow path 201 and, by providing the first flow path 201 to be wide in the X direction, it is possible to suppress a decrease in the density at which the individual flow paths 200 are disposed in the X direction to dispose the individual flow paths 200 at a high density in the X direction. The inertance of the second flow path 202 is preferably higher than the inertance of the first flow path 201. Accordingly, when a pressure change is generated in the ink inside the pressure chamber 12, it is possible to reduce the amount of ink flowing inside the second flow path 202 downstream of the nozzle 21 and efficiently discharge the ink droplet from the nozzle 21.

The third flow path 203 guides the ink from the first common liquid chamber 101 to the first flow path 201 by bypassing the pressure chamber 12 that is a pressurization chamber. Here, the third flow path 203 guiding ink from the first common liquid chamber 101 to the first flow path 201 by bypassing the pressure chamber 12 means that the ink is guided from the first common liquid chamber 101 to the first flow path 201 without passing through the pressure chamber 12. In other words, the third flow path 203 is not directly coupled to the pressure chamber 12 and is coupled to the first common liquid chamber 101 upstream of the pressure chamber 12 and the first flow path 201 downstream of the pressure chamber 12.

In the present embodiment, the third flow path 203 is provided to extend in the Y direction. Here, the direction in which the third flow path 203 extends is the direction in which the ink inside the third flow path 203 flows. The −Y direction end portion of the third flow path 203 communicates with the first flow path 201 and the +Y direction end portion of the third flow path 203 communicates with the first common liquid chamber 101. In the present embodiment, a coupling port of the third flow path 203 with the first flow path 201 is referred to as a first opening 203*a* and a coupling port of the third flow path 203 with the first common liquid chamber 101 is referred to as a third opening 203*b*.

The third flow path 203 of the present embodiment is provided between the second communicating plate 152 and the nozzle plate 20. Specifically, the third flow path 203 is formed by providing a recessed portion in the second communicating plate 152 and covering the opening of the recessed portion with the nozzle plate 20. The third flow path 203 is not particularly limited to this configuration and a recessed portion may be provided in the nozzle plate 20 and the recessed portion of the nozzle plate 20 may be covered with the second communicating plate 152, or alternatively, a recessed portion may be provided in both the second communicating plate 152 and the nozzle plate 20. By extending the third flow path 203 in the Y direction in this manner, the first opening 203*a* and the third opening 203*b* of the third flow path 203 are disposed at the same position in the +Z direction.

In the present embodiment, the third flow path 203 is provided such that a cross-sectional area crossing the ink flowing through the flow path, that is, a cross-sectional area in the plane direction including the X direction and the Z direction has the same area over the Y direction. The second flow path 202 may be provided such that the flow path-crossing cross-sectional area has a different area over the Y direction. The difference in the area crossing the third flow path 203 includes a case in which the height in the Z direction is different along the Y direction, a case in which the width in the X direction is different along the Y direction, and a case in which both are different.

The flow path-crossing cross-sectional shape of the third flow path 203, that is, the cross-sectional shape in the plane direction including the X direction and the Z direction is rectangular. The flow path-crossing cross-sectional shape of the third flow path 203 is not particularly limited, and may be a trapezoid, a semicircle, a semi-ellipse, or the like.

The first opening 203*a*, which is a coupling port between the third flow path 203 and the first flow path 201, and a second opening 202*a*, which is a coupling port between the second flow path 202 and the first flow path 201, are disposed at a position toward the +X direction, which is the first direction in the first flow path 201. Here, the first opening 203*a* and the second opening 202*a* being disposed toward the +X direction of the first flow path 201 means that the first opening 203*a* and the second opening 202*a* are disposed at a position closer to the nozzle 21 with respect to the center C in a flow path length H of the first flow path 201 in the Z direction, that is, on the +Z side. In the present embodiment, the first opening 203*a* and the second opening 202*a* are provided at the end portion of the first flow path 201 in the +Z direction. Accordingly, the first opening 203*a* and the second opening 202*a* are disposed at a position closest to the nozzle 21 in the first flow path 201.

By providing the third flow path 203 in this manner, when ink is circulated from the first common liquid chamber 101 to the second common liquid chamber 102, it is possible to suppress the formation of a region in which retention of the ink occurs, in the present embodiment, a region at the end portion of the first flow path 201 formed by the nozzle plate 20 in which the ink is retained at the corner portions on the side opposite from the second opening 202*a* in the Y direction.

In other words, as illustrated in FIG. 4, a flow of the ink flowing through the first flow path 201 from the first common liquid chamber 101 via the supply path 204 and the pressure chamber 12 and a flow of the ink flowing through the third flow path 203 from the first common liquid chamber 101 are generated at the end portion of the first flow path 201 on the +Z side which is the nozzle 21 side. Therefore, it is possible to cause the ink to flow to the corner portions or the like formed in the first flow path 201 by the nozzle plate 20 to reduce the formation of a portion at which the ink is retained.

In contrast, as illustrated in FIG. 5, when the third flow path 203 is not provided, since the ink flows from the first flow path 201 extending in the +Z direction to the second flow path 202 extending in the −Y direction, a portion which is the end portion of the first flow path 201 on the +Z side, which is the nozzle 21 side, at which the flow of the ink is retained at a corner portion D on the +Y side, which is the side opposite from the second flow path 202, is formed. When the ink is retained at the corner portion D close to the nozzle 21 in this manner, the ink having increased viscosity, the ink in which a component is settled, the bubbles, and the like are retained at the corner D, the ink and the bubbles retained at the corner D enter the nozzle 21 at an unexpected timing and discharging faults and the like occur, caused by variations in the component concentration of the ink discharged from the nozzle 21, variations in the flight direction due to the increased viscosity ink, and the increased viscosity ink or bubbles. Bubbles retained at the corner portion D grow and enter the pressure chamber 12 due to buoyancy, so that the bubbles absorb pressure changes inside the pressure chamber 12 and there is a concern that problems such as the occurrence of discharging faults of the ink droplets may occur.

In the present embodiment, by providing the third flow path 203, since it is possible to reduce portions at which the ink is retained such as the corner portion D, even if the nozzle 21 is provided at a position communicating with the end portion of the first flow path 201, the ink and bubbles do not easily enter the nozzle 21 and it is possible to suppress the discharging faults of the ink droplets.

By providing the third flow path 203, it is possible to form a relatively fast flow of the ink flowing from the first opening 203*a* toward the second opening 202*a* directly above the nozzle 21 on the −Z side. Therefore, it is possible to cause the ink to enter the nozzle 21 to generate a flow of the ink inside the nozzle 21. By generating an ink flow inside the nozzle 21, it is possible to increase the velocity gradient of the ink inside the nozzle 21 to replace the ink inside the nozzle 21 with new ink supplied from upstream. Therefore, the viscosity of the ink inside the nozzle 21 does not easily increase due to drying, and even if the ink inside the nozzle 21 increases in viscosity, since the increased-viscosity ink flows downstream, it is possible to suppress the occurrence of variation in the discharging direction of the ink droplets caused by the increased-viscosity ink remaining inside the nozzle 21, and to suppress the displacement of the landing position of the ink droplets on the ejection target medium.

It is preferable that the third flow path 203 have a smaller cross-sectional area than the first flow path 201. Accordingly, it is possible to increase the flow speed of the ink passing through the third flow path 203 and increase the flow speed of the ink directly above the nozzle 21.

Figure 6:
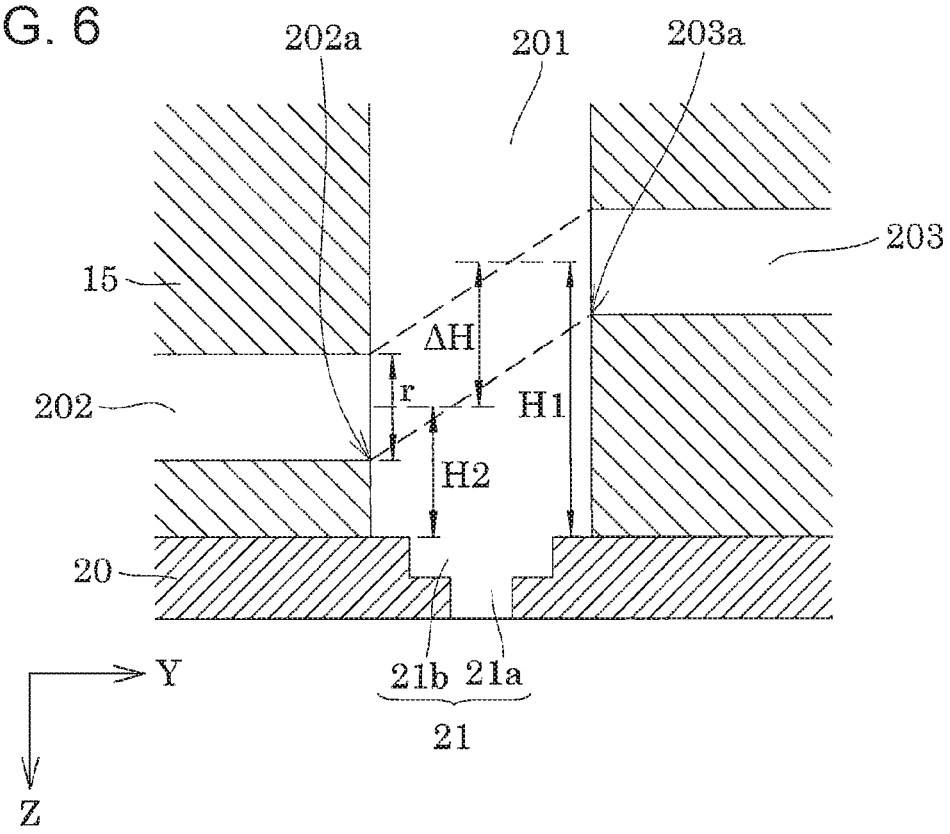
FIG. 6 is a sectional diagram illustrating a modification example of the recording head according to Embodiment 1.

In the present embodiment, although a configuration is adopted in which the first opening 203*a*, which is a coupling port of the third flow path 203 with the first flow path 201, and the second opening 202*a*, which is a coupling port of the second flow path 202 with the first flow path 201 are disposed at the same position in the Z direction, the configuration is not particularly limited thereto. For example, the first opening 203*a* and the second opening 202*a* may be provided at different positions in the Z direction. FIG. 6 illustrates such an example. As illustrated in FIG. 6, the first opening 203*a* of the third flow path 203 and the second opening 202*a* of the second flow path 202 are positioned at positions on the −Z side of the nozzle plate 20, respectively. The first opening 203*a* is positioned closer to the −Z side than the second opening 202*a*. Even in such a configuration, as described above, the first opening 203*a* and the second opening 202*a* may be disposed in the first flow path 201 toward the +Z direction.

Here, the difference between the depth of the first opening 203*a* and the depth of the second opening 202*a* is preferably less than or equal to 5 times and more preferably less than or equal to 2 times the diameter of the second opening 202*a*. The difference between the depth of the first opening 203*a* and the depth of the second opening 202*a* refers to a difference ΔH between a height H1 in the Z direction from the nozzle 21 to the center of the first opening 203*a* and a height H2 in the Z direction from the nozzle 21 to the center of the second opening 202*a*. The centers of the first opening 203*a* and the second opening 202*a* are the centers when the first opening 203*a* and the second opening 202*a* are circular openings. For example, when the openings of the first opening 203*a* and the second opening 202*a* are other than circular, the centers of the first opening 203*a* and the second opening 202*a* are the area centroids.

The diameter of the second opening 202*a* is the maximum opening width of the second opening 202*a* in the Z direction. In other words, when the second opening 202*a* has a circular shape, the diameter refers to the diameter r of the second opening 202*a*.

The difference ΔH between the depth of the first opening 203*a* and the depth of the second opening 202*a* is preferably less than or equal to 5 times and more preferably less than or equal to 2 times the diameter r which is the diameter of the second opening 202*a*. In other words, ΔH≤5r is preferable, and ΔH≤2r is more preferable.

By setting the difference ΔH between the depth of the first opening 203*a* and the depth of the second opening 202*a* to preferably less than or equal to 5 times and more preferably less than or equal to 2 times the diameter r of the second opening 202*a*, it is possible to suppress the retention of the ink at portions at which the ink is easily retained, in the present embodiment, at the corner portion of the first opening 203*a* with the nozzle plate 20. When the difference ΔH between the depth of the first opening 203*a* and the depth of the second opening 202*a* is larger than 5 times the diameter r of the second opening 202*a*, retention of the ink at the corner portion of the first flow path 201 with the nozzle plate 20 occurs more easily.

The first opening 203*a* may be disposed on the +Z side or may be disposed on the −Z side of the second opening 202*a*.

Figure 7:
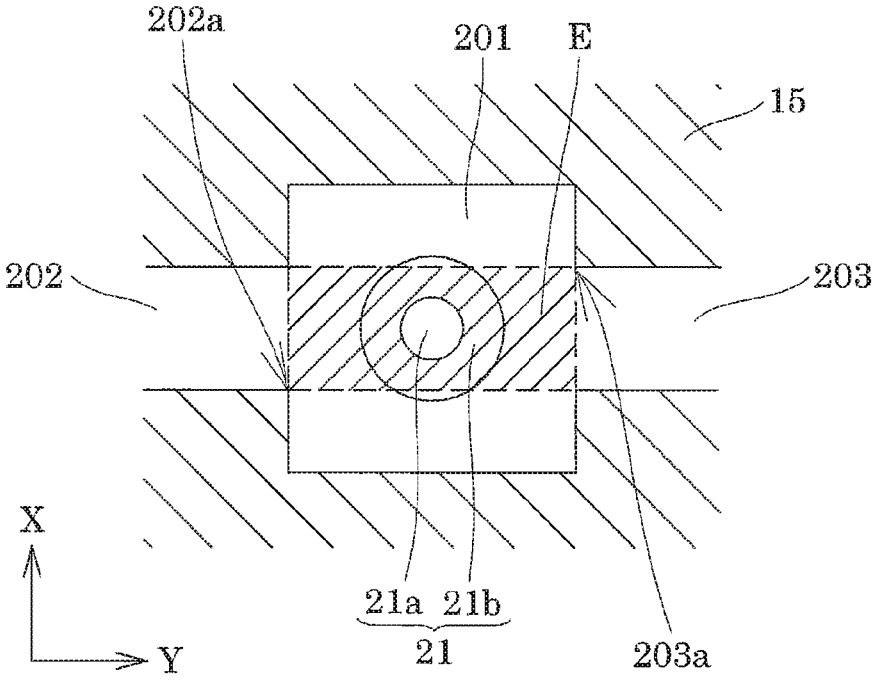
FIG. 7 is a sectional diagram illustrating a flux zone of the recording head according to Embodiment 1.

As illustrated in FIG. 7, in the present embodiment, although a configuration is adopted in which the first opening 203*a* and the second opening 202*a* are disposed at positions mutually facing each other in the Y direction and the nozzle 21 is disposed between the first opening 203*a* and the second opening 202*a*, the configuration is not particularly limited thereto.

Figure 8:
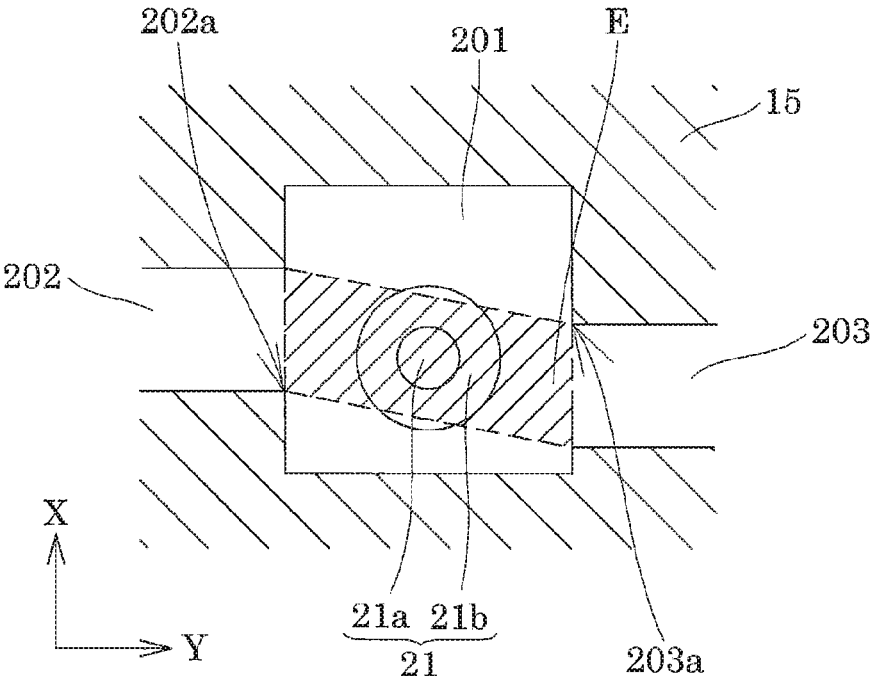
FIG. 8 is a sectional diagram illustrating a modification example of the flux zone of the recording head according to Embodiment 1.

For example, as illustrated in FIG. 8, the first opening 203*a* and the second opening 202*a* may be disposed at positions displaced from each other in the X direction. In this case, when viewed in the +Z direction, the nozzle 21 is preferably disposed at a position overlapping the flux zone E connecting the first opening 203*a* and the second opening 202*a* to each other. Here, the flux zone E defines a range in which the ink flows from the first opening 203*a* toward the second opening 202*a*, and in plan view in the +Z direction, refers to a range surrounded by straight lines connecting the opening edge portion of the first opening 203*a* and the opening edge portion of the second opening 202*a*. As illustrated in FIGS. 7 and 8, by disposing the nozzle 21 to overlap with the flux zone E when viewed in the +Z direction, it is possible to form a flow of the ink from the first opening 203*a* toward the second opening 202*a* directly above the nozzle 21 on the −Z side, and it is possible to form a flow of the ink inside the nozzle 21 so that the ink inside the nozzle 21 is always replaced with new ink. When the nozzle 21 is disposed at a position away from the flux zone E, a flow of the ink is not easily formed directly above the nozzle 21 and a flow of the ink is not easily formed inside the nozzle 21.

In the examples illustrated in FIGS. 7 and 8, although a configuration is adopted in which the first opening 203*a* and the second opening 202*a* open on the side surfaces of the first flow path 201 mutually facing each other in the Y direction, naturally, the configuration is not limited thereto and one or both of the first opening 203*a* and the second opening 202*a* may be provided to open on the side surfaces mutually facing each other in the X direction. Even in such a case, as long as the nozzle 21 is disposed at a position overlapping the flux zone E, it is possible to form a flow of the ink directly above the nozzle 21 to form a flow of the ink inside the nozzle 21.

The inertance of the third flow path 203 is preferably higher than the inertance of the second flow path 202. Here, as described above, one end of the third flow path 203 in the −Y direction is the first opening 203*a* coupled to the first flow path 201, and the other end of the third flow path 203 in the +Y direction is an end portion communicating with the first communicating portion 16, which is the end portion of the first communicating portion 16 in the −Y direction. One end of the second flow path 202 in the +Y direction is the second opening 202*a* coupled to the first flow path 201 and the other end of the second flow path 202 in the −Y direction is an end portion that communicates with the second common liquid chamber 102 and is an end portion of the third communicating portion 18 in the +Y direction.

The inertance of the second flow path 202 is higher than the inertance of the first flow path 201. In other words, inertance of third flow path 203>inertance of second flow path 202>inertance of first flow path 201.

As described above, by setting the inertance of the third flow path 203 higher than the inertance of the second flow path 202, since more ink flows to the nozzle 21 via the first flow path 201, the ink discharging properties, in particular, the weight of the ink does not easily reduce.

The description has been made on the assumption that the flow of the ink flows from the first common liquid chamber 101 to the second common liquid chamber 102 via the pressure chamber 12, the first flow path 201, and the second flow path 202. However, it is possible to use an ink jet recording head in which the opposite flow is generated, that is, the ink flows sequentially from the second common liquid chamber 102 to the second flow path 202, the first flow path 201, the pressure chamber 12, and the first common liquid chamber 101. Even in such a case, since the streamline of the ink from the second flow path 202 to the third flow path 203 is generated directly above the nozzle 21, it is possible to efficiently collect the ink in the vicinity of the nozzle.

As described above, the ink jet recording head 1 includes the first common liquid chamber 101 and the second common liquid chamber 102 communicating with the nozzle 21, the pressure chamber 12 provided between the first common liquid chamber 101 portion and the nozzle 21, the first flow path 201 extending between the pressure chamber 12 and the nozzle 21 in the +Z direction toward the nozzle 21, the second flow path 202 branched from the first flow path 201 and leading to the second common liquid chamber 102, and the third flow path 203 that bypasses the pressure chamber 12 and leads to the first flow path 201 from the first common liquid chamber 101, in which the first opening 203*a*, which is a coupling port between the third flow path 203 and the first flow path 201, and the second opening 202*a*, which is a coupling port between the second flow path 202 and the first flow path 201, are positioned in the first flow path 201 toward the +Z direction. The ink jet recording head 1 is an example of the liquid ejecting head of the present embodiment, the pressure chamber 12 is the pressurization chamber, and the +Z direction is the first direction.

Since it is possible to generate a flow component from the first opening 203*a* to the second opening 202*a* at a position in the first flow path 201 toward the +Z direction by providing the third flow path 203 in this manner, it is possible to suppress portions at which the ink is retained. Accordingly, the retention of ink and bubbles in the vicinity of the nozzle 21 is suppressed and it is possible to suppress the ink having different concentrations or components being discharged from the nozzle 21 at an unexpected timing and the occurrence of air bubbles entering the nozzle 21 or the pressure chamber 12 and discharging faults of ink occurring.

By generating a flow of the ink from the first opening 203*a* to the second opening 202*a* in the +Z direction toward the nozzle 21, it is possible to increase the flow speed of the ink directly above the nozzle 21 on the −Z side. Therefore, the flow of the ink inside the nozzle 21 is generated and it is possible to replace the ink inside the nozzle 21 with new ink supplied from upstream. Therefore, it is possible to suppress the ink being retained inside the nozzle 21 and it is possible to suppress the occurrence of discharging faults such as clogging of the nozzle 21 caused by an increase in the viscosity of the retained ink, displacement of the flight direction of the ink droplet discharged from the nozzle 21, and the like.

As compared to a case in which the nozzle 21 is caused to communicate with the second flow path 202 by causing the nozzle 21 to communicate with the first flow path 201 extending in the +Z direction, an increase in the flow path resistance from the pressure chamber 12 to the nozzle 21 is suppressed, a reduction in the discharging properties of the ink droplet, that is, the weight of the ink droplet to be discharged is suppressed, and it is possible to drive the piezoelectric actuator 300 using a relatively low drive voltage, and it is possible to improve the discharging efficiency.

In the recording head 1 of the present embodiment, the first opening 203*a* and the second opening 202*a* are preferably provided at the end portion of the first flow path 201 in the +Z direction, which is the first direction. Accordingly, it is possible to provide the first opening 203*a* and the second opening 202*a* at positions closer to the nozzle 21 and it is possible to generate a flow of the ink flow directly above the nozzle 21 on the −Z side to generate a flow of the ink inside the nozzle 21.

In the recording head 1 of the present embodiment, the difference ΔH between the depth of the first opening 203*a* and the depth of the second opening 202*a* in the +Z direction, which is the first direction, is preferably less than or equal to 5 times and more preferably less than or equal to 2 times the diameter r of the second opening 202*a*. By setting the difference ΔH between the depth of the first opening 203*a* and the depth of the second opening 202*a* to preferably less than or equal to 5 times and more preferably less than or equal to 2 times the diameter r of the second opening 202*a*, it is possible to suppress the retention of the ink at portions at which the ink is easily retained.

In the recording head 1 of the present embodiment, when viewed in the +Z direction, which is the first direction, the nozzle 21 is preferably disposed in a range overlapping the flux zone E connecting the first opening 203*a* and the second opening 202*a* to each other. Accordingly, by disposing the nozzle 21 at a position overlapping the flux zone E when viewed in the +Z direction, it is possible to form a flow of the ink from the first opening 203*a* toward the second opening 202*a* directly above the nozzle 21 on the −Z side, and it is possible to generate a flow of the ink inside the nozzle 21 so that the ink inside the nozzle 21 is always replaced with new ink.

In the recording head 1 of the present embodiment, the inertance of the third flow path 203 is preferably higher than the inertance of the second flow path 202. As described above, by setting the inertance of the third flow path 203 higher than the inertance of the second flow path 202, since more ink flows to the nozzle 21 via the first flow path 201, the ink discharging properties, in particular, the weight of the ink does not easily reduce.

Embodiment 2

Figure 9:
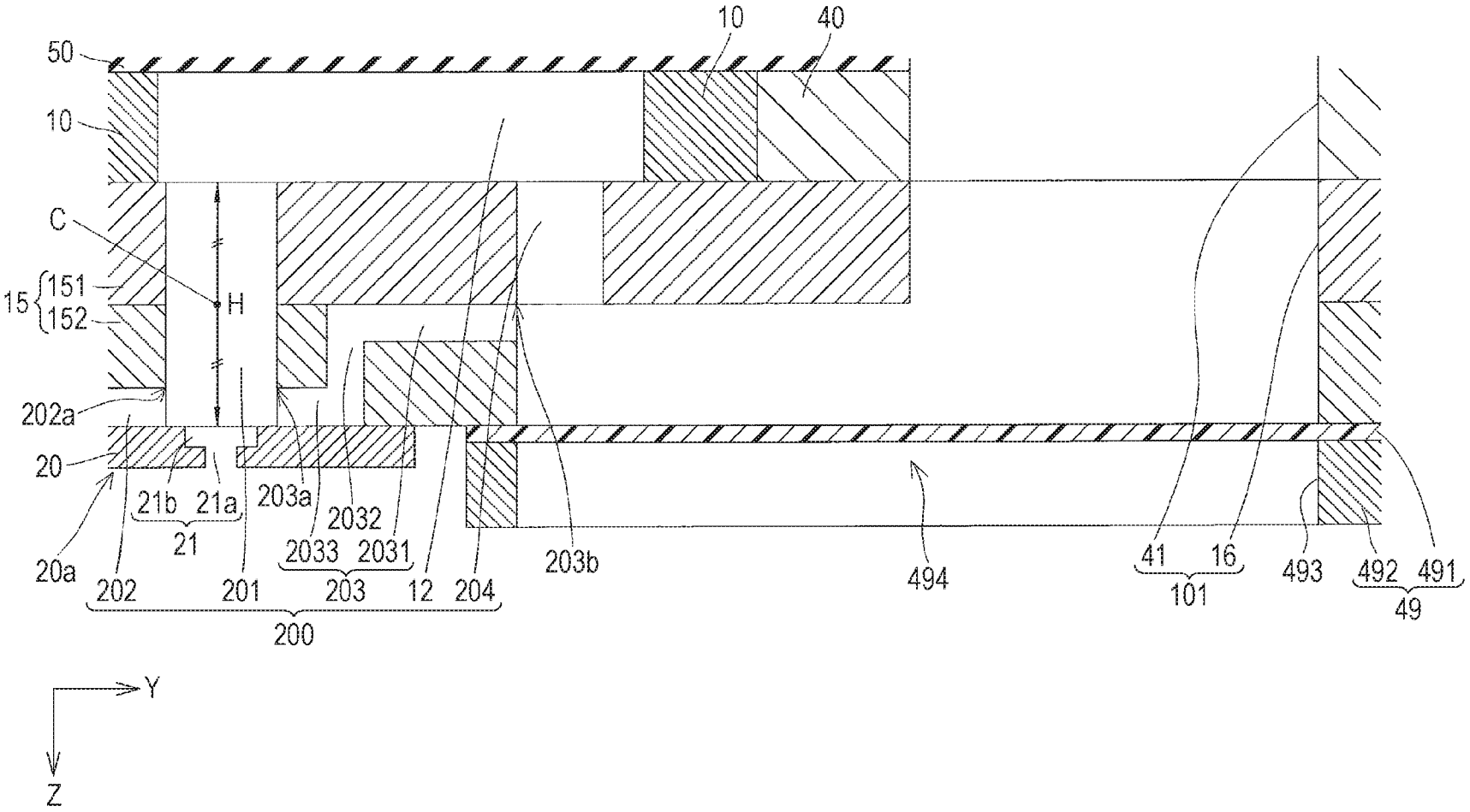
FIG. 9 is a sectional diagram of a recording head according to Embodiment 2.

FIG. 9 is an enlarged sectional diagram of the main parts of an ink jet recording head, which is the liquid ejecting head according to Embodiment 2 of the present disclosure. The same members as those in the embodiment described above are given the same reference numerals and redundant description will be omitted.

The third flow path 203 includes a first portion 2031, a second portion 2032, and a third portion 2033.

The first portion 2031 is provided to extend in the Y direction between the first communicating plate 151 and the second communicating plate 152. The first portion 2031 of the present embodiment is formed by providing a recessed portion that opens on the +Z side surface of the second communicating plate 152 and covering the recessed portion with the first communicating plate 151. Naturally, the configuration is not limited thereto, and the first portion 2031 may be provided with a recessed portion in the first communicating plate 151 and cover the recessed portion of the first communicating plate 151 with the second communicating plate 152, or the first portion 2031 may be formed by providing recessed portions in both the first communicating plate 151 and the second communicating plate 152.

The end portion of the first portion 2031 in the +Y direction communicates with the first common liquid chamber 101.

The second portion 2032 communicates with an end portion of the first portion 2031 in the −Y direction and is provided to extend through the second communicating plate 152 in the Z direction.

The third portion 2033 is provided to extend between the second communicating plate 152 and the nozzle plate 20 in the Y direction. The end portion of the third portion 2033 in the +Y direction communicates with the end portion of the second portion 2032 on the +Z side and the end portion of the third portion 2033 in the −Y direction is coupled to the first flow path 201.

In the third flow path 203, since only the third portion 2033 is provided between the communicating plate 15 and the nozzle plate 20, the nozzle plate 20 is provided with an area that covers the third portion 2033.

A compliance substrate 49 separate from the nozzle plate 20 is provided at the opening of the first communicating portion 16 on the +Z side. The compliance substrate 49 seals the opening of the first common liquid chamber 101 on the +Z side.

In the present embodiment, the compliance substrate 49 includes a sealing film 491 formed of a thin flexible film and a fixed substrate 492 formed of a hard material such as a metal. Since the region of the fixed substrate 492 facing the first common liquid chamber 101 is an opening portion 493 completely removed in the thickness direction, a portion of the wall surface of the first common liquid chamber 101 is the compliance portion 494 which is a flexible portion sealed only by the flexible sealing film 491. By providing the compliance portion 494 on a portion of the wall surface of the first common liquid chamber 101 in this manner, it is possible to absorb the pressure fluctuation of the ink inside the first common liquid chamber 101 by the compliance portion 494 being deformed.

By configuring the third flow path 203 using the first portion 2031, the second portion 2032, and the third portion 2033 in this manner, it is possible to form the nozzle plate 20 with a relatively narrow area and it is possible to reduce the cost.

Embodiment 3

Figure 10:
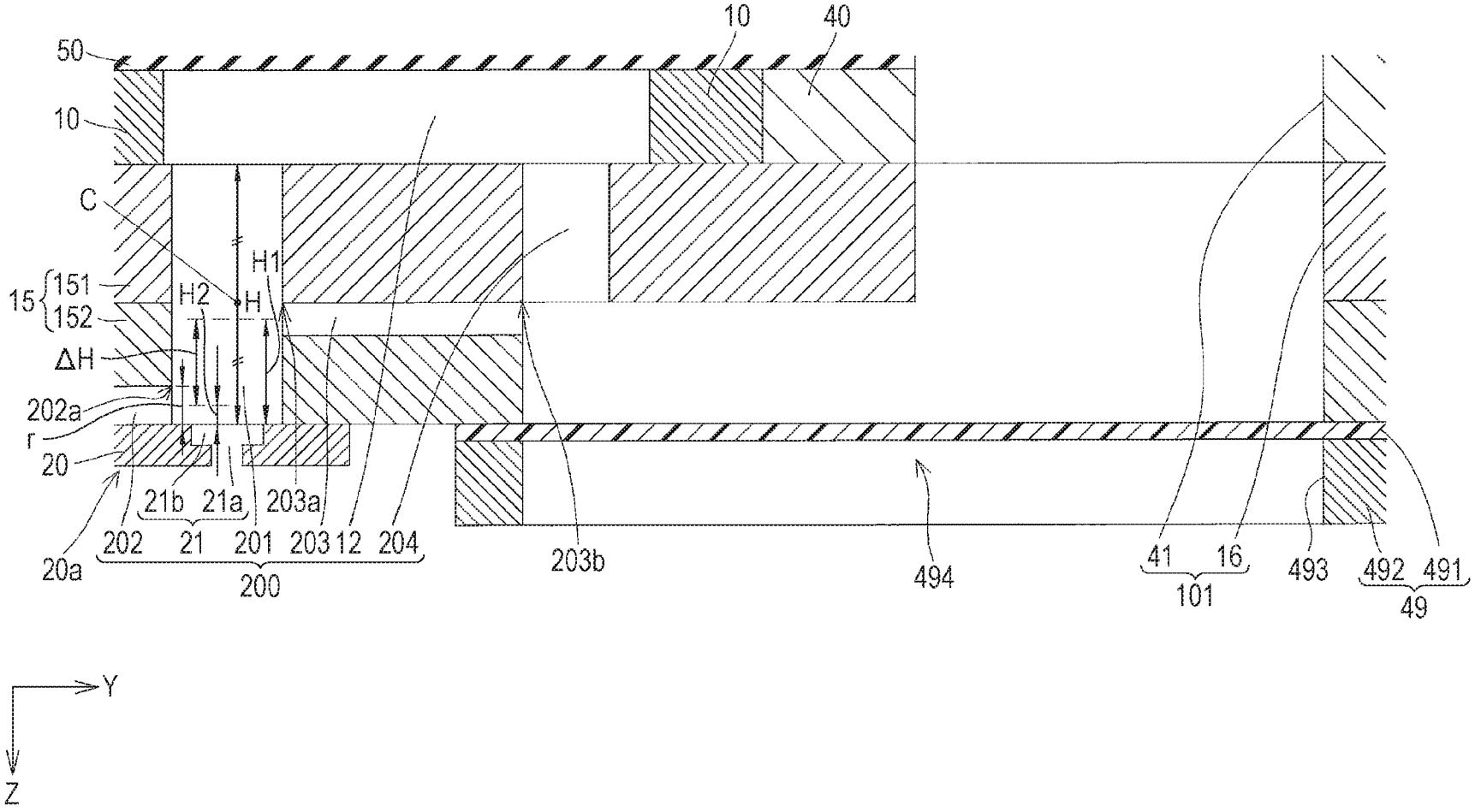
FIG. 10 is a sectional diagram of a recording head according to Embodiment 3.

FIG. 10 is an enlarged sectional diagram of the main parts of an ink jet recording head, which is an example of the liquid ejecting head according to Embodiment 3 of the present disclosure.

As illustrated in FIG. 10, the third flow path 203 of the present embodiment is provided at a position away from the nozzle plate 20 in the −Z direction and extends in the Y direction.

In the present embodiment, the third flow path 203 is provided between the first communicating plate 151 and the second communicating plate 152. Specifically, the third flow path 203 is formed by providing a recessed portion in the second communicating plate 152 open to the −Z direction and covering the opening of the recessed portion with the first communicating plate 151. Naturally, the third flow path 203 is not limited to this configuration, and may be formed such that the first communicating plate 151 is provided with a recessed portion that opens in the +Z direction and the opening of the recessed portion is covered with the second communicating plate 152, or the third flow path 203 may be formed such that both the first communicating plate 151 and the second communicating plate 152 are provided with recessed portions.

The first opening 203*a*, which is the coupling port of the third flow path 203 with the first flow path 201, is disposed at a position in the first flow path 201 toward the +Z direction. In other words, the first opening 203*a* of the third flow path 203 is disposed closer to the +Z side with respect to the center of the first flow path 201 in the Z direction.

Here, it is possible to realize disposing the third flow path 203 at a position in the first flow path 201 toward the +Z direction, for example, by rendering the thickness of the second communicating plate 152 in the Z direction to be thinner than the thickness of the first communicating plate 151 in the Z direction.

Even in a case in which the first communicating plate 151 and the second communicating plate 152 have the same thickness, by providing the recessed portion in the second communicating plate 152 and covering the recessed portion with the first communicating plate 151 to form the third flow path 203 as in the present embodiment, it is possible to dispose the first opening 203*a* of the third flow path 203 in the first flow path 201 toward the +Z direction.

Since the +Z side surface of the third flow path 203 is formed by the communicating plate 15 by disposing the third flow path 203 closer to the −Z side with respect to the nozzle plate 20 in this manner, it is not necessary to provide the nozzle plate 20 to extend to a position facing the +Z side of the third flow path 203. Therefore, the nozzle plate 20 of the present embodiment is provided to reach a position in the +Y direction at which the opening of the first flow path 201 is opened.

The compliance substrate 49 is provided on the +Z side surface of the communicating plate 15 and the +Z side opening of the first common liquid chamber 101 is sealed by the compliance substrate 49.

It is possible to form the nozzle plate 20 with a relatively narrow area and reduce the cost by disposing the third flow path 203 at a position closer to the −Z side with respect to the nozzle plate 20 as described above.

Even in a case in which the third flow path 203 is disposed closer to the −Z side with respect to the nozzle plate 20, in the same manner as the embodiments described above, it is preferable that the difference between the depth of the first opening 203*a* of the third flow path 203 and the depth of the second opening 202*a* of the second flow path 202 in the +Z direction, that is, the difference ΔH between the height H1 of the center of the first opening 203*a* from the nozzle 21 in the Z direction and the height H2 of the center of the second opening 202*a* from the nozzle 21 in the Z direction be less than or equal to 5 times and more preferably less than or equal to 2 times the diameter r of the second opening 202*a*.

In the present embodiment, although a configuration is exemplified in which the third flow path 203 is coupled to the first common liquid chamber 101, the configuration is not particularly limited thereto, and since it is sufficient for the third flow path 203 to guide the ink from the first common liquid chamber 101 to the first flow path 201, bypassing the pressure chamber 12, the third flow path 203 may be coupled to the supply path 204, for example. In other words, the third opening 203*b* of the third flow path 203 may be open in the side surface of the supply path 204.

Other Embodiments

Although the embodiments of the present disclosure are described above, the basic configuration of the present disclosure is not limited to the above-described embodiment.

Figure 11:
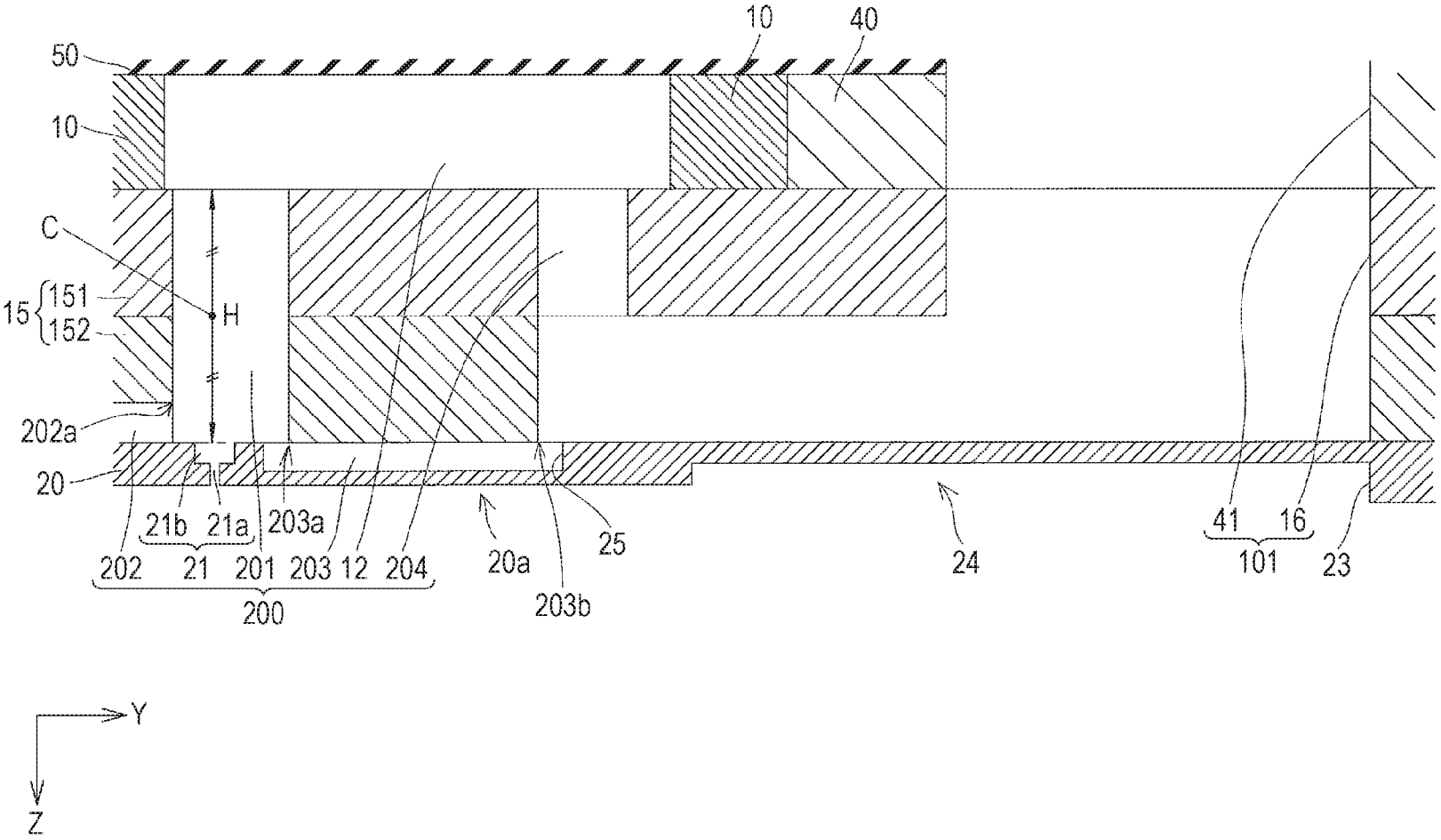
FIG. 11 is a sectional diagram of a recording head according to another embodiment.

For example, in Embodiment 1 described above, the third flow path 203 is formed between the communicating plate 15 and the nozzle plate 20 by providing a recessed portion in the communicating plate 15 and covering the recessed portion with the nozzle plate 20. However, the configuration is not particularly limited thereto, and the third flow path 203 and the nozzle 21 may be provided in the nozzle plate 20 which is a single substrate. FIG. 11 illustrates such an example. As illustrated in FIG. 11, the third flow path 203 is formed by providing a recessed portion 25 in the nozzle plate 20 that opens on the −Z side and covering the opening of the recessed portion 25 with the communicating plate 15. Accordingly, the third flow path 203 is provided to extend between the communicating plate 15 and the nozzle plate 20 in the Y direction. Even in such a configuration, by providing the third flow path 203, the region in which the ink is retained is reduced, the flow speed of the ink directly above the nozzle 21 is increased, and it is possible to generate the flow of the ink inside the nozzle 21.

For example, in each of the embodiments described above, a configuration is exemplified in which the nozzles 21 are arranged in the X direction orthogonal to both the Y direction and the Z direction with the first axial direction as the Y direction and the second axial direction as the Z direction. However, the configuration is not particularly limited thereto. For example, the nozzles 21, the pressure chambers 12, and the like may be arranged side by side in a direction inclined with respect to the X direction in the in-plane direction of a nozzle surface 20*a*.

In each of the embodiments described above, although the first flow path 201 of the individual flow path 200 and the second common liquid chamber 102 are directly coupled, the configuration is not particularly limited thereto, and another flow path extending in the Z direction, which is the second axial direction, may be provided between the first flow path 201 and the second common liquid chamber 102.

In each of the embodiments described above, although the nozzle 21 is disposed at a position communicating with the end portion of the first flow path 201, the configuration is not particularly limited thereto, and the nozzle 21 may be disposed at a position communicating with the middle of the second flow path 202. In other words, the nozzle 21 may be provided to branch in the +Z direction from the second flow path 202 extending in the Y direction. Accordingly, ink droplets are ejected from the nozzle 21 in the +Z direction. In other words, the nozzle 21 may be provided to extend through the nozzle plate 20 in the Z direction such that the end portion of the nozzle 21 in the −Z direction communicates with the middle of the second flow path 202 and the end portion of the nozzle 21 in the +Z direction opens to the nozzle surface 20*a* of the nozzle plate 20. By disposing the nozzle 21 at a position communicating with the second flow path 202, it is possible to improve the degree of freedom in the disposing of the nozzle 21.

Here, the nozzle 21 being provided to branch from the first flow path 201 means that the nozzle 21 communicates with the middle of the first flow path 201. That the nozzle 21 communicating with the middle of the first flow path 201 means that the nozzle 21 is disposed at a position overlapping the first flow path 201 when viewed in plan view in the Z direction. When the nozzle 21 is disposed at a position overlapping the second flow path 202 when viewed in plan view in the Z direction, the nozzle 21 is not considered to be provided to communicate with the middle of the first flow path 201. In other words, the first flow path 201 of the present embodiment is a portion that does not overlap the second flow path 202 when viewed in plan view in the Z direction.

Figure 12:
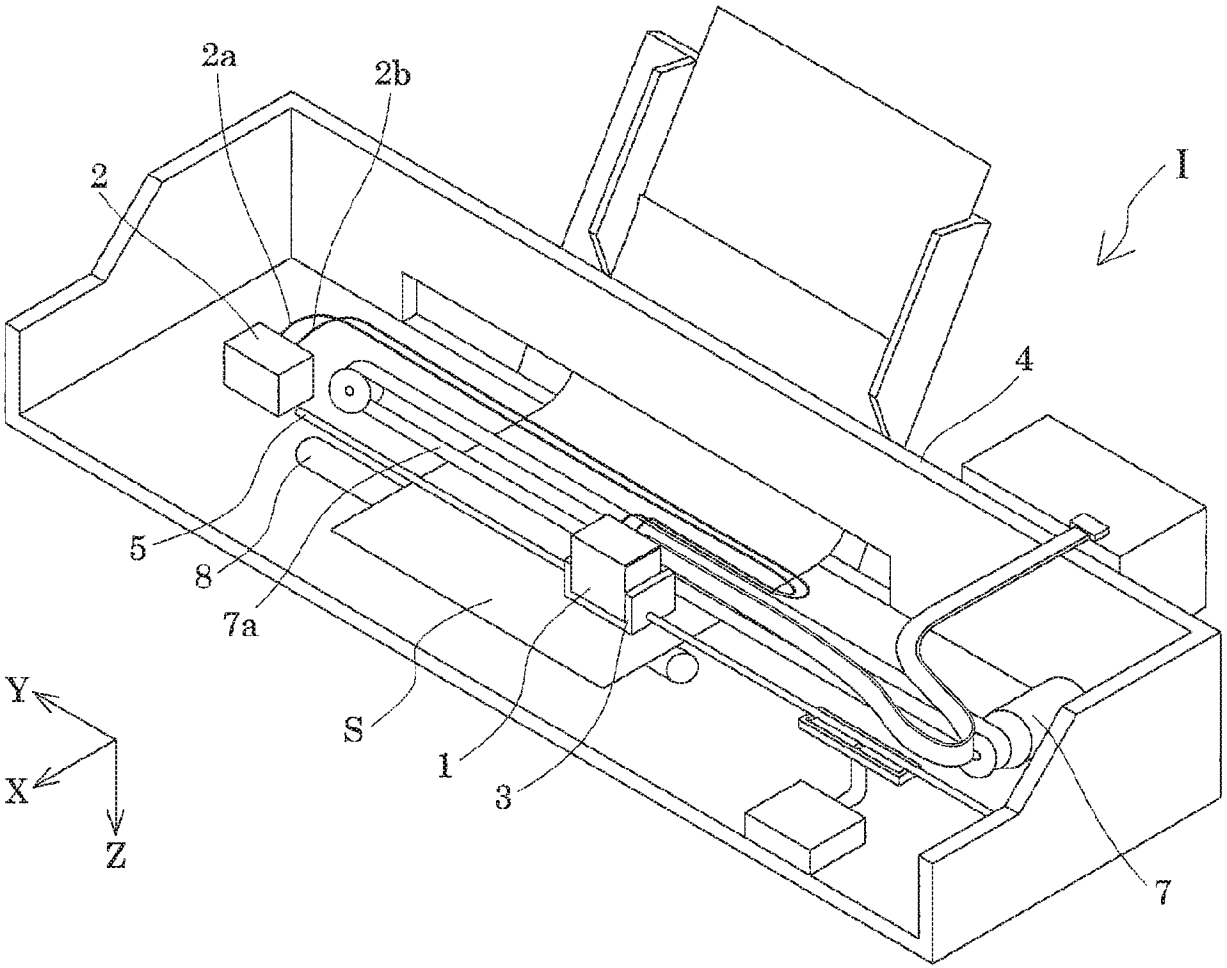
FIG. 12 is a perspective view illustrating a schematic configuration of a recording apparatus according to an embodiment.

Here, an example of an ink jet recording apparatus, which is an example of the liquid ejecting apparatus of the present embodiment, will be described with reference to FIG. 12. FIG. 12 is a perspective view illustrating a schematic configuration of the ink jet recording apparatus of the present disclosure.

As illustrated in FIG. 12, in an ink jet recording apparatus I, which is an example of a liquid ejecting apparatus, two or more recording heads 1 are mounted on a carriage 3. The carriage 3 on which the recording heads 1 are mounted is provided on a carriage shaft 5 attached to an apparatus main body 4 to move freely in the axial direction. In the present embodiment, the moving direction of the carriage 3 is the Y direction, which is the first axial direction.

The apparatus main body 4 is provided with a tank 2 which is a storage unit in which ink is stored as a liquid. The tank 2 is coupled to the recording head 1 via a supply pipe 2*a* such as a tube and the ink from the tank 2 is supplied to the recording head 1 via the supply pipe 2*a*. The recording head 1 and the tank 2 are coupled via a discharge pipe 2*b* such as a tube and the ink discharged from the recording head 1 is returned to the tank 2 via the discharge pipe 2*b*, that is, so-called circulation is performed. The tank 2 may be formed by two or more tanks.

The driving force of a drive motor 7 is transmitted to the carriage 3 via gears (not illustrated) and a timing belt 7*a*, and thus, the carriage 3 on which the recording head 1 is mounted is moved along the carriage shaft 5. On the other hand, the apparatus main body 4 is provided with a transport roller 8 which serves as a transport unit and a recording sheet S which is an ejection target medium such as paper is transported by the transport roller 8. The transport unit that transports the recording sheet S is not limited to the transport roller 8 and may be a belt, a drum, or the like. In the present embodiment, the transport direction of the recording sheet S is the X direction.

In the ink jet recording apparatus I described above, a configuration is exemplified in which the recording head 1 is mounted on the carriage 3 and moves in a main scanning direction. However, the configuration is not particularly limited thereto, and for example, it is possible to apply the present disclosure to a so-called line type recording apparatus in which the recording head 1 is fixed and the printing is performed by only moving the recording sheet S such as paper in the sub-scanning direction.

In each embodiment, the ink jet recording head is described as an example of the liquid ejecting head and the ink jet recording apparatus is described as an example of the liquid ejecting apparatus. However, the present disclosure widely targets liquid ejecting heads and liquid ejecting apparatuses in general, and naturally, it is possible to apply the present disclosure to a liquid ejecting head or a liquid ejecting apparatus that ejects a liquid other than the ink. Examples of other liquid ejecting heads include various recording heads used in image recording apparatuses such as printers, color material ejecting heads used in manufacturing color filters of liquid crystal displays and the like, electrode material ejection heads used for forming electrodes of organic EL displays, FEDs (field emission displays), and the like, and biological organic material ejection heads used for manufacturing biochips, and it is also possible to apply the present disclosure to a liquid ejecting apparatus provided with such a liquid ejecting head.

Figure 13:
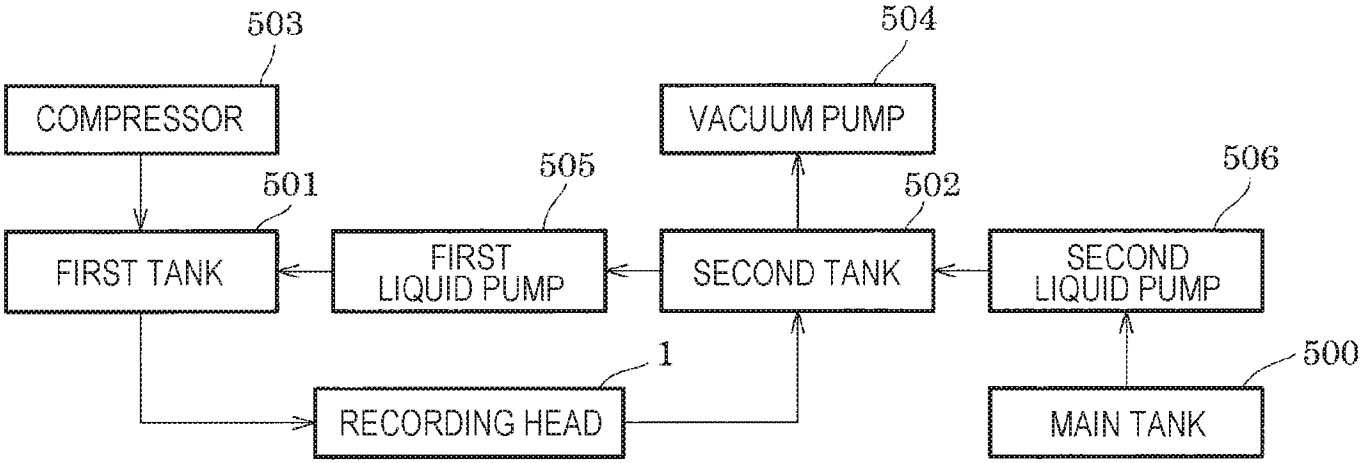
FIG. 13 is a block diagram illustrating a liquid ejecting system according to an embodiment.

Here, an example of the liquid ejecting system of the present embodiment will be described with reference to FIG. 13. FIG. 13 is a block diagram illustrating the liquid ejecting system of the ink jet recording apparatus which is the liquid ejecting apparatus of the present disclosure.

As illustrated in FIG. 13, the liquid ejecting system includes the recording head 1 and, as a mechanism for supplying the ink as the liquid to the supply port 43, collecting the ink from the discharge port 44, and circulating the ink, includes a main tank 500, a first tank 501, a second tank 502, a compressor 503, a vacuum pump 504, a first liquid pump 505, and a second liquid pump 506.

The recording head 1 and the compressor 503 are coupled to the first tank 501, and the ink in the first tank 501 is supplied to the recording head 1 at a predetermined pressure by the compressor 503.

The second tank 502 is coupled to the first tank 501 via the first liquid pump 505, and the ink in the second tank 502 is pumped to the first tank 501 by the first liquid pump 505.

The recording head 1 and the vacuum pump 504 are coupled to the second tank 502, and the ink of the recording head 1 is discharged to the second tank 502 at a predetermined negative pressure by the vacuum pump 504.

In other words, the ink is supplied from the first tank 501 to the recording head 1 and the ink is discharged from the recording head 1 to the second tank 502. The ink is circulated by the ink being pumped from the second tank 502 to the first tank 501 by the first liquid pump 505.

The main tank 500 is coupled to the second tank 502 via the second liquid pump 506, and an amount of the ink corresponding to that consumed by the recording head 1 is replenished in the second tank 502 from the main tank 500. The replenishment of the ink in the second tank 502 from the main tank 500 may be performed, for example, at a timing when the liquid level of the ink in the second tank 502 becomes lower than a predetermined height.

What is claimed is:

1. A liquid ejecting head that discharges a liquid from a nozzle, the liquid ejecting head comprising:

a first common liquid chamber and a second common liquid chamber that communicate with the nozzle;

a pressurization chamber provided between the first common liquid chamber and the nozzle;

a first flow path extending between the pressurization chamber and the nozzle in a first direction toward the nozzle;

a second flow path branching from the first flow path and leading to the second common liquid chamber; and a third flow path that bypasses the pressurization chamber and leads to the first flow path from the first common liquid chamber; wherein a first opening, which is a coupling port between the third flow path and the first flow path, and a second opening, which is a coupling port between the second flow path and the first flow path, are positioned in the first flow path in the first direction close to the nozzle, and wherein the pressurization chamber is downstream in a liquid flow direction of the first common liquid chamber.

2. The liquid ejecting head according to claim 1, wherein the first opening and the second opening are provided at an end portion of the first flow path in the first direction.

3. The liquid ejecting head according to claim 1, wherein a difference between a depth of the first opening and a depth of the second opening in the first direction is less than or equal to 5 times a diameter of the second opening.

4. The liquid ejecting head according to claim 3, wherein the difference between the depth of the first opening and the depth of the second opening in the first direction is less than or equal to 2 times the diameter of the second opening.

5. The liquid ejecting head according to claim 1, wherein the nozzle is disposed in a range overlapping a flux zone connecting the first opening and the second opening when viewed in the first direction.

6. The liquid ejecting head according to claim 1, wherein the third flow path and the nozzle are provided at a single substrate.

7. The liquid ejecting head according to claim 1, wherein the first opening is positioned in the first flow path in the first direction closer to the nozzle than a third opening, which is a coupling port between the third flow path and the first common liquid chamber.

8. The liquid ejecting head according to claim 1, wherein an inertance of the third flow path is higher than an inertance of the second flow path.

9. A liquid ejecting system comprising:

the liquid ejecting head according to claim 1; and a mechanism configured to supply a liquid to the liquid ejecting head, collect the liquid from the liquid ejecting head, and circulate the liquid.

* * * * *